United States Patent [19]

Johenning et al.

[11] Patent Number: 4,932,088

[45] Date of Patent: Jun. 12, 1990

[54] WATER MATTRESS CONSTRUCTION

[75] Inventors: Jeb B. Johenning, Beverly Hills; James M. Haar, West Los Angeles, both of Calif.

[73] Assignee: Advanced Sleep Products, Carson, Calif.

[21] Appl. No.: 219,602

[22] Filed: Jul. 15, 1988

[51] Int. Cl.[5] ..... A47C 27/08

[52] U.S. Cl. ..... 5/400; 5/451; 5/470

[58] Field of Search ..... 5/186 R, 186 B, 400, 5/401, 411, 451, 452, 470

[56] References Cited

U.S. PATENT DOCUMENTS

| | | | |
|---|---|---|---|
| 3,585,356 | 6/1971 | Hall | 5/451 X |
| 4,145,780 | 3/1979 | Fogel | 5/451 X |
| 4,145,781 | 3/1979 | Autrey et al. | 5/451 X |
| 4,187,566 | 2/1980 | Peterson | 5/451 |
| 4,187,567 | 2/1980 | Crowther | 5/451 |
| 4,413,367 | 11/1983 | Miller et al. | 5/451 X |
| 4,602,396 | 7/1986 | Fraige | 5/451 |
| 4,757,564 | 7/1988 | Goodale | 5/451 |

*Primary Examiner*—Michael F. Trettel

*Attorney, Agent, or Firm*—Kinzer, Plyer, Dorn, McEachran & Jambor

[57] ABSTRACT

A mattress construction includes a water mattress and a rigid, peripheral and bottom support for the water mattress. There is a resilient cushion extending about and over the water mattress and the rigid support. A flexible cover is positioned about the resilient cushion. There are lift-off, lock-down means in the form of facing peripheral hook and loop fastener strips which integrate the cushion, cover, water mattress and support into a unitary structure.

19 Claims, 2 Drawing Sheets

WATER MATTRESS CONSTRUCTION

SUMMARY OF THE INVENTION

The present invention relates to a water bed mattress construction in which the rigid support for the water mattress, a resilient cushion which extends about and over the water mattress and support, and a flexible cover for the resilient cushion are all integrated into a single unit by matching and interlocking hook and loop fastener strips on the cover and a portion of the support.

One purpose of the invention is a waterbed mattress construction in which the resilient cushion forming the mattress cover is interlocked to the water mattress support to prevent the cover from pulling up when a person sits on the side of the waterbed and to insure that the sides of the mattress construction retain their initial vertical configuration.

Another purpose is a waterbed mattress construction in which the resilient cushion has portions of differing density to provide a firmer support at the border where a person may sit on the bed and a somewhat softer cushion in the central area normally used for sleeping.

Another purpose is a water mattress construction having an improved support tray which provides both increased strength for the tray and improved appearance.

Another purpose is a waterbed mattress construction having a moisture barrier which permits the passage of odors from the waterbed, but retains condensation and moisture in the area of the water mattress.

Another purpose is an improved support tray for a water mattress in which the volume of the cavity for the water mattress is slightly larger than the volume of the water mattress to retain water from a small leak within the support tray.

Another purpose is a water mattress construction in which the support tray with water filled mattress containers therein may be easily moved for proper positioning on the underlying foundation.

Another purpose is an improved water mattress construction in which the flexible foam cover is integrated into the underlying support by a lift-off lock-down structure including matching hook and loop fastener strips.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
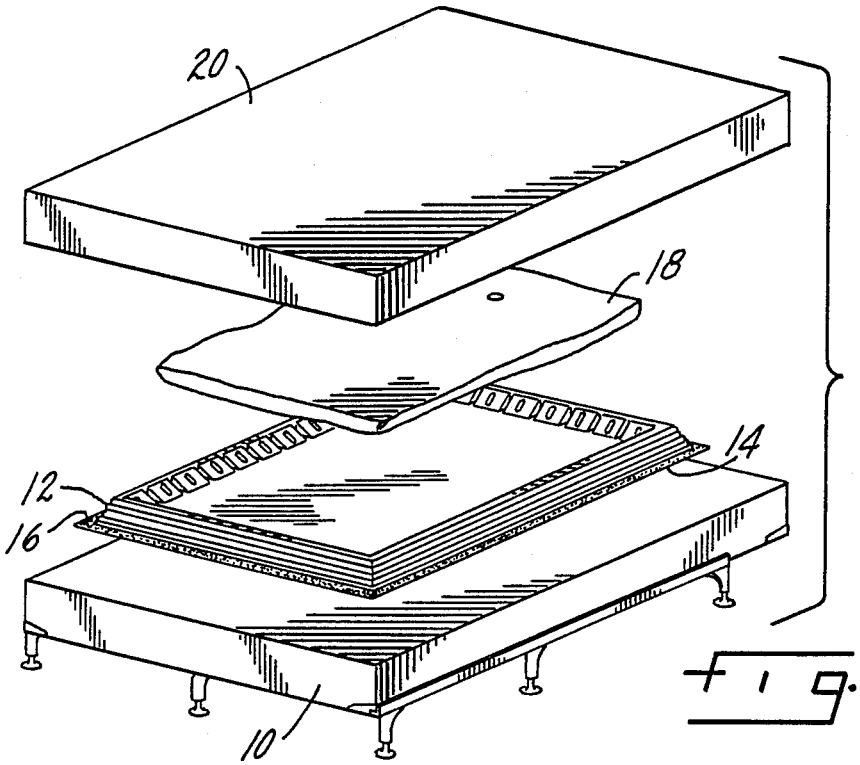
FIG. 1 is an exploded perspective illustrating the improved water mattress construction of the present invention.

The present invention relates to a water mattress construction in which a water mattress, which may be one, two or more water containers, is supported by a rigid tray. In some applications the water containers may contain a suitable baffling structure, for example as shown in U.S. Pat. No. 4,467,485. By the use of small peripherally-spaced recesses in the tray the actual volume of the tray cavity is greater than that of the water mattress positioned therein so that water leaking from the mattress will be retained in the tray. A vapor barrier rests on top of the water mattress and the supporting tray and a resilient cushion is positioned over the vapor barrier, water mattress and tray. The cushion is formed of sections of different density to provide a firm border and a relatively less dense central sleeping area. The resilient cushion is covered by a quilted fabric. A thin layer of fabric may be positioned beneath and attached to the rigid tray and may carry a peripheral hook and loop fastener strip. A matching hook and loop fastener strip on the quilted fabric cover provides a lift-up, lock-down interconnection between the cover and the tray integrating these elements into a single assembly.

In prior waterbed constructions using a soft-sided cover, if a person sits on the edge of the cover, adjacent areas of the cover pull up and away from the underlying foundation. Also, over a period of time the walls of the resilient cover tend to bow out, either along the top or along the bottom, and the mattress sides do not retain their original vertical appearance. By utilizing a lift-up, lock-down construction, for example hook and loop fastener strips of the type sold under the registered trademarks VELCRO or SCOTCH-MATE, the integrated cover and tray retain their original appearance, even after years of use.

There have been attempts in prior waterbed constructions to attach the cover to the water mattress support by a peripheral zipper. This connection is time consuming and zippers always have the possibility of becoming jammed. The present invention provides lift-up, lock-down hook and loop fastener strips which not only integrate the entire unit into a single assembly, but provide for easy removal of the cover, if required.

A filled water mattress may weigh up to 500 lbs. In the present invention the filled mattress and its supporting underlying tray may be easily moved about the waterbed foundation as the tray is positioned upon and adhered to a thin layer of strong fabric and the hook and loop fastener strips are peripherally outside of the tray and on the fabric. This combination of elements is easily moved about the waterbed foundation because of the slippery character of the material used in the fabric. In the alternative, the fastener strips may be attached to a thin border layer of plastic of defined width and low coefficient of friction which is bonded to the bottom of the tray around its outer periphery. In either construction the filled water mattress and support are easily movable on the foundation.

In FIG. 1, the waterbed foundation is indicated at 10 and may be a typical box configuration supported by a plurality of feet. Positioned on foundation 10 is a rigid tray 12 which may be formed of a suitable plastic, for example polyethylene. Tray 12 is seated upon a fabric layer 14 which is bounded by a peripheral hook and loop fastener strip 16. The material 14 may, for example, be a 3 oz. grey typar, although other fabrics are equally satisfactory. What is important is that fabric layer 14 be easily moved about on the underlying foundation 10.

Figure 2:
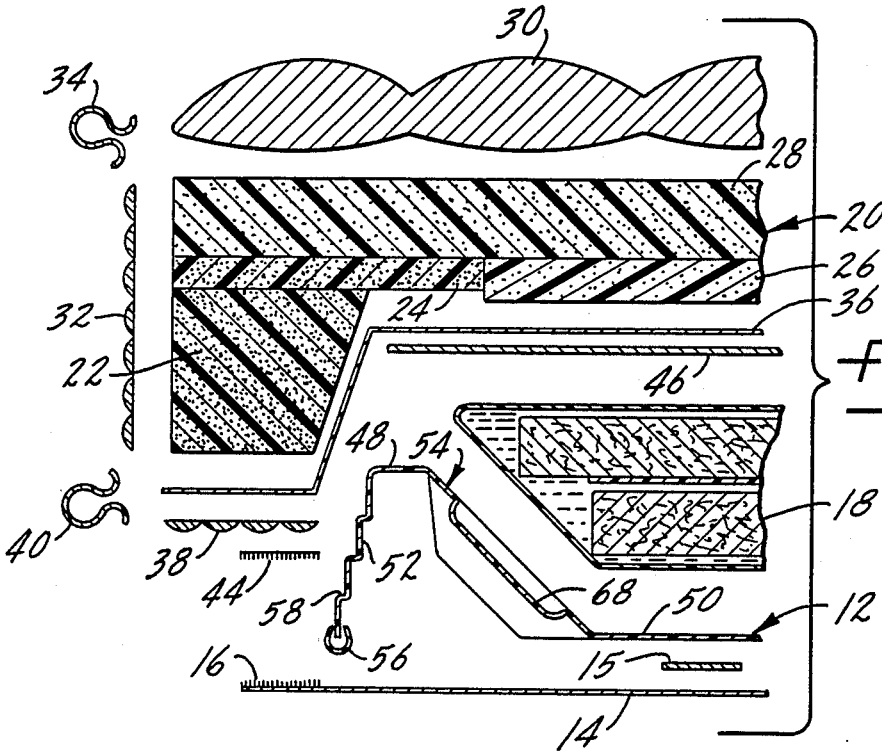
FIG. 2 is an enlarged exploded cross section through the water mattress construction of FIG. 1.

A water container is indicated at 18 and the water mattress cover is indicated at 20. Although only one water container is shown in the embodiment described herein, it is clearly within the scope of the invention to use two or multiple water containers to form the water mattress. As shown in FIG. 2, the water mattress may contain a baffle structure such as shown in the above-mentioned U.S. patent.

The cover 20 preferably consists of multiple sections of a suitable foam material. There is a peripheral border or wall 22 which is glued to a border top layer 24 which may be made of a foam material having the same density as border 22. The central area of the cover is formed by a top 26 which may be made of material having substantially less density than that of sections 22 and 24. An upper layer 28 overlies the entire cushion and may be of an intermediate density and is adhered to both cushion sections 24 and 26. By way of example, and without limitation, cushion sections 22 and 24 may be made of a material having a density of from 75–80 ILD; section 26 may be made up of a resilient material having a density of 10–50 ILD; and section 28 may be made up of a material having a density of 15–30 ILD. The firmer material at the edge provides support for a person sitting on the edge of the bed, whereas, the softer interior provides a more advantageous sleeping area. Upper layer 28 provides a gradual transition from firm border to the relatively soft center.

As shown in FIG. 2, cushion section 26 is slightly thicker than section 24. This is to accommodate an underfilled water container. In the alternative, sections 24 and 26 may have the same thickness and the water container may be close to filled. What is important is that the foam cushions and the water container together provide optimum sleeping comfort and appearance.

The resilient cushion may be covered by a layer of quilted material 30 which may be attached to a quilted border 32 by first sewing the fabric borders and then covering the peripheral seam by a tape 34. The underside of the cushion may have a layer of fabric indicated at 36 which may, for example, be a white-coated tietex which can be glued to the inside surfaces of the cushion sections. The bottom of the cushion, in the border area, may be covered by a quilted material 38 which may be the same as quilted border 32. Again, bottom 38 may be sewn to quilted border 32 and the seam covered by a tape 40.

Bottom layer 14, which is attached to the bottom of tray 12 by a double-sided adhesive strip 15, will have a releasable adhering strip 16 about its periphery. In practice, the peripheral strip 16 may be divided into sections which will mate with similar releasable adhering strips 44 attached to the bottom of quilted layer 38. Preferably, the strips 16 and 44 are hook and loop fasteners and, as is well known, interlocking strips of this type provide an easily releasable but firm attachment for two elements. In this case the strips permit the cover to be lifted off, but yet locked down to the supporting tray which sits upon fabric layer 14.

There is a vapor barrier 46 which covers the area of water mattress 18 and extends over and masks the upper surface 48 of supporting tray 12. The vapor barrier may be two layers of spun bonded polypropylene laminated over a meltbound adhesive and may be of the type sold by Kimberly-Clark Corporation under the designation SMS fabric. This material has the unique property of passing air while maintaining a high degree of water resistance. Thus, air and odors will pass through it, but moisture will not.

Figure 3:
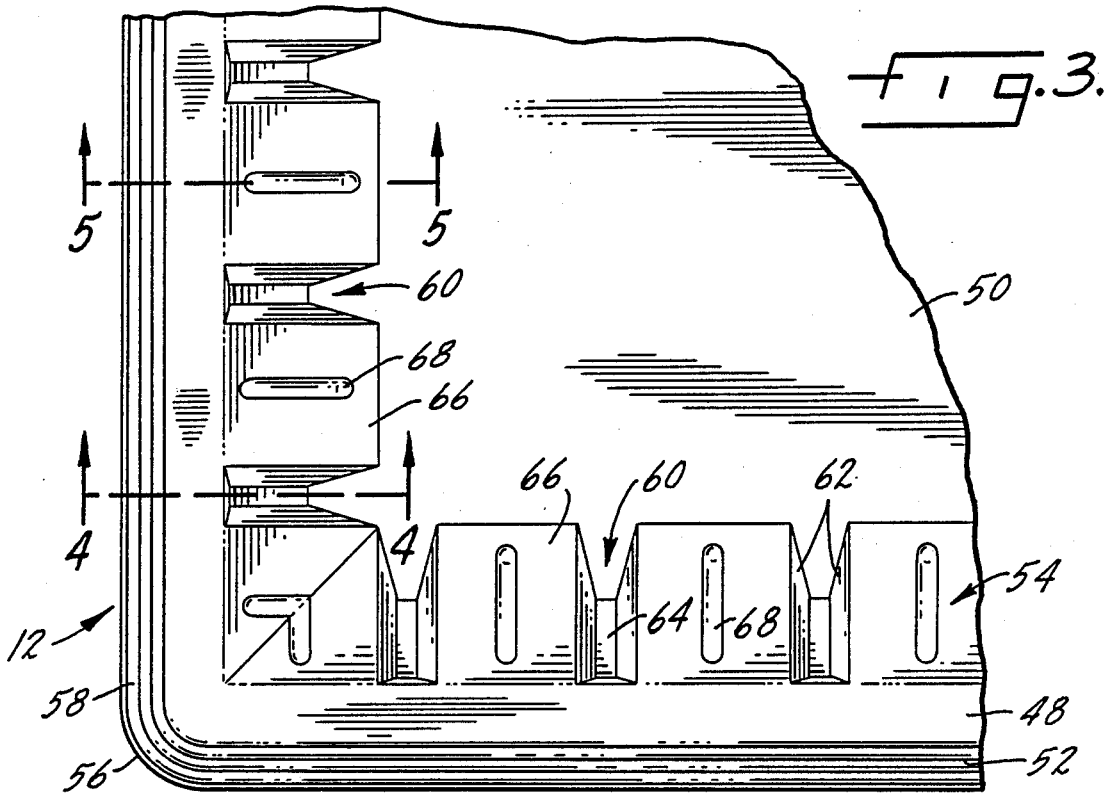
FIG. 3 is an enlarged partial top plan view of the support tray used in the construction of FIGS. 1 and 2.
Figure 4:
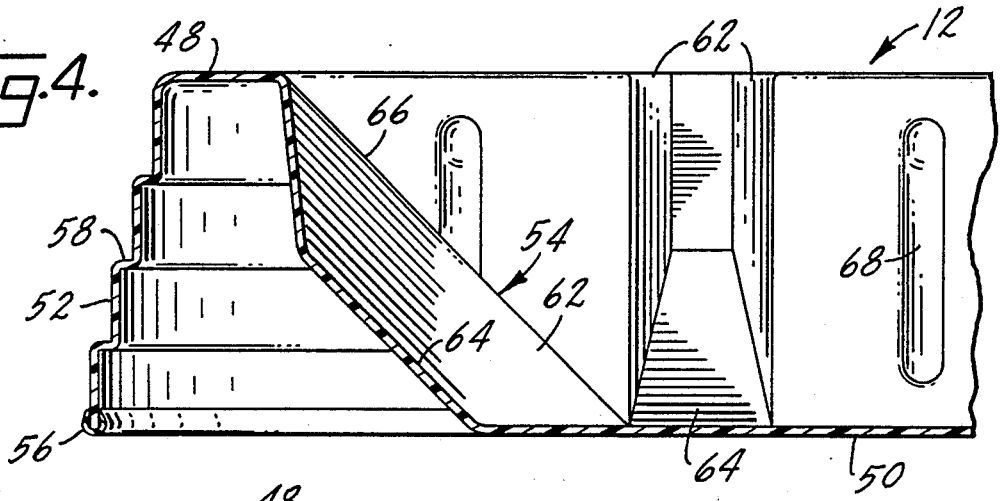
FIG. 4 is a section along plane 413 4 of FIG. 3.
Figure 5:
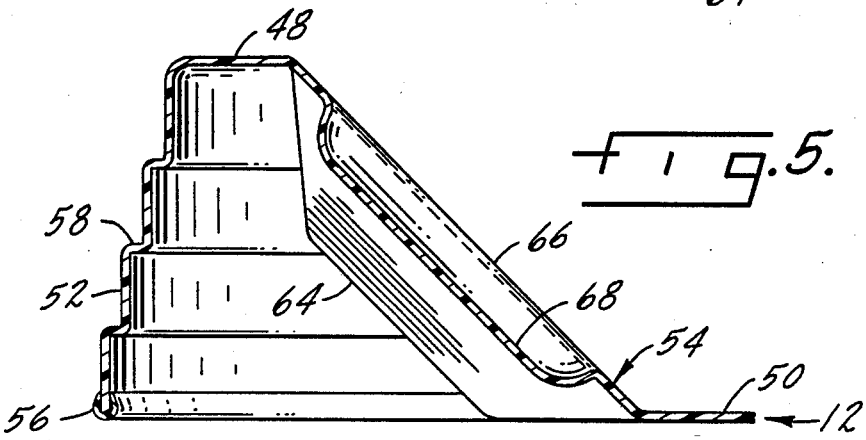
FIG. 5 is a section along plane 5—5 of FIG. 3.

The rigid supporting tray 12 is indicated in detail in FIGS. 3, 4 and 5. Preferably, the tray will be a single molded unit, for example of polyethylene, and will have a bottom 50, an outer wall 52, and an inner slanted wall 54. Outer wall 52 may have a bottom decorative rim 56 and the exterior of wall 52 may have a series of steps, indicated at 58. The steps not only provide added strength for the outer wall, but also provide a clearly decorative effect to the appearance of the supporting tray.

As illustrated in the top view of FIG. 3, the inwardly-slanted interior wall 54 may have a plurality of generally uniformly spaced grooves or recesses 60, each of which has slanted walls 62 and a slanted bottom 64. The effect of the recesses 60 is to increase the volume of the cavity containing the water mattress, for example about 7.5%, so that its capacity is greater than that of the water mattress, since the mattress cannot extend into the recesses. This is advantageous in that in the event there is a small leak in the water mattress, that water can flow into the recesses and will not flow out of the cavity of the support. Thus, any leakage is contained within the waterbed construction.

In addition, each of the sections 66 formed between recesses 60 may have an intermediate indentation 68 which has the effect of adding further strength to the interior walls of the support 12.

Although the particular cushion, along with its quilted fabric cover, and the hook and loop fastener strips for attaching the covered cushion to the waterbed support, have been used in connection with a rigid water mattress support, the invention should not be so limited. Certain aspects of the invention are equally functional with a soft-sided water mattress support.

Whereas the preferred form of the invention has been shown and described herein, it should be realized that there may be many modifications, substitutions and alterations thereto.

The embodiments of the invention in which an exclusive property or privilege is claimed are defined as follows:

1. In a mattress construction, a water mattress, a peripheral and bottom support for said water mattress, a resilient cushion extending about and over said water mattress and support, a flexible cover for said resilient cushion, and lift-off, lock-down means including releasable adhering strips on a lower surface of said cover and an upward-facing portion of said support for integrating the cushion, cover, water mattress and support into a unitary structure to prevent the cushion and cover from lifting away from the support when a person is on the mattress construction, but permitting removal of the cushion and cover from the support for access to the water mattress.

2. The mattress construction of claim 1 further characterized in that said releasable adhering strips extend peripherally about a lower surface of said cover and an upward facing portion of said support.

3. The mattress construction of claim 2 further characterized in that said support includes a tray having a central cavity for said water mattress and a thin layer of material beneath said tray, upon which one of said peripheral releasable adhering strips is positioned.

4. The mattress construction of claim 3 further characterized in that said support is rigid.

5. The mattress construction of claim 1 further characterized by and including a vapor barrier on the underside of said cushion and facing said water mattress.

6. The mattress construction of claim 1 further characterized in that said cushion includes peripherally-extending foam sides and a foam top, with said sides being formed of a material having greater density than the material of the top.

7. In a mattress construction, a water mattress, a rigid tray having an inwardly-slanted interior wall and an integral bottom providing an interior cavity for said water mattress, an exterior peripheral wall for said tray integral with said interior wall, a resilient cushion extending about and over said water mattress and rigid tray, said tray interior wall having a plurality of spaced recesses formed therein whereby the volume of said rigid tray cavity is greater than the volume of said water mattress, and lift-off lock-down means for integrating said cushion, water mattress and tray into a unitary structure to prevent the cushion from lifting away from the rigid tray when a person is on the mattress construction, but permitting removal of the cushion from the rigid tray for access to the water mattress.

8. The mattress construction of claim 7 further characterized in that said rigid tray exterior wall has a plurality of progressively, outwardly-extending strengthening steps.

9. The mattress construction of claim 7 further characterized by and including a decorative rim positioned about the bottom edge of said tray exterior wall.

10. The mattress construction of claim 9 further characterized by and including a thin layer of material beneath said rigid tray, said lift-off, lock-down means including peripheral releasable adhering strips on a lower surface of said cushion and on an upward-facing surface of said thin layer of material, said releasable adhering strips being peripherally outside of said rigid tray outer wall rim.

11. The mattress construction of claim 7 further characterized in that said resilient cushion includes a resilient outer peripheral wall and a resilient top attached to said outer wall, said outer wall material having a greater density than the material of said resilient top.

12. The mattress construction of claim 11 further characterized in that said resilient cushion is supported on said rigid tray.

13. The mattress construction of claim 12 further characterized by and including a vapor barrier coextensive with said rigid tray and positioned between said tray and said resilient cushion.

14. In a mattress construction, a water mattress, a rigid peripheral and bottom support for said water mattress, resilient cushion include a peripheral outer wall of a first density extending about said rigid support, said outer wall having an inwardly-extending ledge which is supported on said water mattress support, and a resilient top of a second density adhered to said inwardly-extending ledge and overlying said water mattress, said first density being greater than said second density, a flexible cover on said resilient cushion, and lift-off, lock-down means including releasable adhering strips on a lower surface of said coover and an upward-facing portion of said support for integrating the cushion, cover, water mattress and rigid support into a unitary structure to prevent the cushion and cover from lifting away from the rigid support when a person is on the mattress construction, but permitting removal of the cushion and cover from the rigid support for access to the water mattress.

15. The mattress construction of claim 14 further characterized by and including a resilient upper layer for said cushion, said upper layer overlying and being adhered to both said peripheral outer wall and said top.

16. The mattress construction of claim 15 further characterized in that said upper layer has a density intermediate that of said cushion peripheral outer wall and top.

17. The mattress construction of claim 14 further characterized in that said flexible cover extends beneath said resilient cushion outer wall, a thin layer of material beneath said rigid support, said lift-off, lock-down releasable adhering strips being positioned on that portion of the cover which extends beneath said resilient cushion outer wall and on an upwardly-facing portion of the layer of material which is beneath said rigid support.

18. The mattress construction of claim 17 further characterized in that said releasable adhering strips are hook and loop fastener strips.

19. The mattress construction of claim 17 further characterized by and including a vapor barrier positioned between said resilient cushion and said water mattress and generally co-extensive with the upper surface of said rigid support.

* * * * *